US005937470A

United States Patent [19]

Duncan

[11] Patent Number: 5,937,470

[45] Date of Patent: Aug. 17, 1999

[54] METAL FITTING CLEANER

[76] Inventor: David Duncan, 18 Coronado Ct., Brookville, Ohio 45309

[21] Appl. No.: 09/038,756

[22] Filed: Mar. 11, 1998

[51] Int. Cl.[6] ..... A46B 13/02; B08B 9/00

[52] U.S. Cl. ..... 15/88; 15/21.1; 15/104.04; 15/104.095

[58] Field of Search ..... 15/4, 21.1, 22.1, 15/23, 28, 65, 70, 71, 75, 88, 104.04, 104.095

[56] References Cited

U.S. PATENT DOCUMENTS

| | | | |
|---|---|---|---|
| 827,866 | 8/1906 | Hart | 86/23 |
| 1,056,774 | 3/1913 | Brooks et al. | 15/59 |
| 1,532,256 | 4/1925 | Moller | 118/254 |
| 2,340,215 | 1/1944 | Fowler | 15/59 |
| 2,793,473 | 5/1957 | Hickman | 15/88 X |
| 3,000,026 | 9/1961 | Prins et al. | 15/88.3 |
| 3,027,688 | 4/1962 | Zabransky | 451/65 |
| 3,067,443 | 12/1962 | Romens et al. | 15/21.1 |
| 4,158,246 | 6/1979 | Meadows et al. | 15/28 |
| 4,554,696 | 11/1985 | Nye, Jr. | 15/88.3 |
| 4,791,693 | 12/1988 | Kvaternik | 15/3.17 |
| 5,156,634 | 10/1992 | Yang | 15/75 |
| 5,475,889 | 12/1995 | Thrasher et al. | 15/88.3 |
| 5,540,186 | 7/1996 | Udelle | 119/609 |
| 5,560,066 | 10/1996 | McDivitt | 15/88.3 |

*Primary Examiner*—Mark Spisich

*Attorney, Agent, or Firm*—Biebel & French

[57] ABSTRACT

A metal fitting cleaner includes a support; an electrical power supply; a first bearing assembly mounted by the support; a first brush detachably mounted by the first bearing assembly for pivotal movement; a first electric motor which is mounted by the support and which is mechanically coupled to the first bearing assembly for pivotably driving the first brush; a second bearing assembly mounted by the support; a second brush detachably mounted by the second bearing assembly for pivotal movement; and a second electric motor which is mounted by the support and which is mechanically coupled to the second bearing assembly for pivotably driving the second brush. Preferably, the first and second brushes are of different size or configuration. The first bearing assembly includes a first normally-open pressure switch in electrical communication with the first electric motor for conducting electrical power from the electrical power supply to the first electric motor when the first normally-open pressure switch detects an axial force no less than a first threshold force. Likewise, the second bearing assembly includes a second normally-open pressure switch in electrical communication with the second electric motor for conducting the electrical power from the electrical power supply to the second electric motor when the second normally-open pressure switch detects an axial force no less than a second threshold force. The invention provides a portable, easy-to-use cleaner which maximizes its efficiency by directing power only to those brushes actually used in a scouring operation.

13 Claims, 3 Drawing Sheets

METAL FITTING CLEANER

BACKGROUND OF THE INVENTION

1. Field of the Invention

The present invention relates to a metal fitting cleaner. More specifically, the invention is a metal fitting cleaner including a plurality of detachably-mounted, independently-driven brushes of different sizes controlled by pressure-sensitive actuators, thereby providing a portable, easy-to-use device for preparing fittings of different sizes for welding. Among the advantages of the independent brush operation are that, while any one brush is in use, the other brushes do not rotate near the user's hand. The cleaner is preferably powered by a removable battery that can be recharged.

2. Description of the Prior Art

Copper pipe and other fittings used in plumbing are often welded together to form conduits. Since surface impurities or oxide films impede the ability of such pipes and fittings to form strong welds, it is considered good practice to thoroughly clean the surfaces of pipes and fittings to be welded, such as by scouring the surfaces with metal brushes. Brushes of different sizes and configurations are required to scour different fittings.

Various proposals have been made to combine brushes of different sizes in a single cleaning device for the convenience of a user. For example, Romens et al. U.S. Pat. No. 3,067,443 proposed a lightweight fitting cleaning machine having a base for an electric motor including a first shaft engaged through a coupling with a second shaft for rotating a wire brush. The second shaft carried an eccentric cam which operated to move a yoke with a reciprocal movement. The yoke supported a rack engaged with gears which were in turn fixed to shafts so as to impart reciprocal movement to two other wire brushes. Thus, although it is believed that only one wire brush would be used at a time, all three wire brushes were engaged in pivotable movement about parallel axes whenever the machine was operating. This increased the power required to operate the machine, which, in turn, increased the size of the motor required for its operation.

Prins U.S. Pat. No. 3,000,026 and Zabransky U.S. Pat. No. 3,027,688 proposed other machines combining brushes of different sizes for scouring fittings. In both Prins et al. and Zabransky, bulky chain drives were provided to allow single motors to drive all of the brushes simultaneously, even though it appears that only one brush was to be used at a time.

Meadows et al. U.S. Pat. No. 4,158,246 proposed a hand-held, portable, cordless scrubber which incorporated counter-rotating, scrubbing brushes detachably mounted on counter-rotating, concentric shafts. The scrubber housing provided a pocket with a detachable cover for receiving a battery pack which could be recharged by direct plugging into an ordinary AC household receptacle. Both finger actuated, handle-mounted switch and brush actuated switch arrangements were proposed. Both of the concentric, counter-rotating brushes appear to have been driven by a single motor and no provision appears to have been made for independently-driven brushes of different sizes or configurations.

It is undesirable to have unused brushes rotating near the user's hand. Therefore, there remains a need in the art for a portable, easy-to-use metal fitting cleaner which conserves power and avoids unnecessary exposure of the user's hands by driving only those brushes needed for a particular scouring operation.

SUMMARY OF THE INVENTION

This need and others are addressed by an apparatus for use with a first brush and a second brush for cleaning metal fittings. The apparatus comprises a support; at least one motor mounted by the support; a first bearing assembly mounted by the support for supporting the first brush for pivotal movement about a first axis; and a second bearing assembly mounted by the support for supporting the second brush for pivotal movement about a second axis. The first bearing assembly includes a first pressure-sensitive actuator such that the one or more motors are enabled to pivotably drive the first brush about the first axis independently of the second brush when the first pressure-sensitive actuator detects a force as large as, or larger than, a first threshold force directed along the first axis. Likewise, the second bearing assembly includes a second pressure-sensitive actuator such that the one or more motors are enabled to pivotably drive the second brush about the second axis independently of the first brush when the second pressure-sensitive actuator detects a force as large as, or larger than, a second threshold force directed along the second axis.

The apparatus of the present invention provides a protable, easy-to-use metal fitting cleaner. In order to scour a fitting prior to welding, the user merely mounts the first and second brushes on the first and second bearing assemblies, respectively, and presses one of the first and second brushes against the surface of the fitting to be scoured. Which of the brushes the user selects depends on the nature and size of the fitting to be cleaned as well as the size and configuration of each of the brushes. The reaction force on the brush triggers the pressure-sensitive actuator. The pressure-sensitive actuator, in turn, actuates the one or more electric motors to pivot the brush against the fitting surface.

The present invention makes efficient use of power due to its simplicity of construction as compared to the proposed prior devices referred to earlier. Since the first and second brushes are driven independently of each other, no power is wasted driving unused brushes. Since the power is used more efficiently, smaller motors may be used, increasing the portability of the apparatus.

More specifically, the invention encompasses a metal fitting cleaner including a support and an electrical power supply, which preferably includes a battery. The metal fitting cleaner preferably includes a first bearing assembly mounted by the support; a first brush detachably mounted by the first bearing assembly for rotation about a first axis; and a first electric motor which is mounted by the support and which is mechanically coupled to the first bearing assembly for pivotably driving the first brush. In addition, the metal fitting cleaner preferably includes a second bearing assembly mounted by the support; a second brush detachably mounted by the second bearing assembly for rotation about a second axis; and a second electric motor which is mounted by the support and which is mechanically coupled to the second bearing assembly for pivotably driving the second brush.

The use of separate dedicated electric motors for each brush and the direct mechanical coupling of each motor to its corresponding brush minimizes the power requirements of the cleaner. This, in turn, permits relatively small electric motors to be used, thereby decreasing the size and weight, and improving the portability, of the cleaner.

Alternatively, it is within the contemplation of the invention to use a single electric motor to drive both the first and second brushes. This may be accomplished by means of an electromechanical transmission system capable of independently engaging the first and second bearing assemblies. Among the drawbacks to the use of such a transmission system would be the increased complexity and power consumption as compared with a cleaner having a separate motor dedicated to each brush, as well as the cost to manufacture a transmission system small enough to maintain the portability of the cleaner. It is likewise within the contemplation of the invention to provide a mechanism or servocontrol to induce one or all of the brushes to pivot about the axis in a reciprocal, rather than a rotary, fashion.

In an especially preferred form, the first and second brushes are of different sizes. Alternatively, one of the first and second brushes is an outer radial brush, that is, a brush having bristles (preferably metal bristles) radiating outwardly from a spindle, and the other of the first and second brushes is an inner radial brush, that is, a brush having bristles radiating inwardly from a pivotable ring. An outer radial brush is favorably adapted for cleaning the interior surface of a female fitting while an inner radial brush is favorably adapted for cleaning the exterior surface of a male fitting. Despite the description of the invention in terms of apparatus for use with first and second brushes, it is to be understood that the number of brushes is not critical to the invention.

The first bearing assembly preferably includes a first normally-open pressure switch in electrical communication with the first electric motor for conducting electrical power from the electrical power supply to the first electric motor when the first normally-open pressure switch detects a force as large as, or larger than, a first threshold force directed along the first axis. Likewise, the second bearing assembly preferably includes a second normally-open pressure switch in electrical communication with the second electric motor for conducting the electrical power from the electrical power supply to the second electric motor when the second normally-open pressure switch detects a force as large as, or larger than, a second threshold force directed along the second axis.

While the preferred pressure-sensitive actuators for controlling the electric motors are pressure switches, it is within the contemplation of the invention to substitute analog or digital pressure transducers in combination with control circuits for actuating the electric motors when axial forces on the corresponding brushes exceed threshold values. Though such an adaptation would be within the ordinary skill in the art, the mechanism and circuitry required to carry out such an adaptation likely would increase the complexity, and decrease the power efficiency, of the cleaner.

Therefore, it is one object of the invention to provide a portable, easy-to-use metal fitting cleaner having improved power efficiency. Other objects and advantages of the invention will be apparent from the following description, the accompanying drawings and the appended claims.

DETAILED DESCRIPTION OF THE PREFERRED EMBODIMENTS

Figure 1:
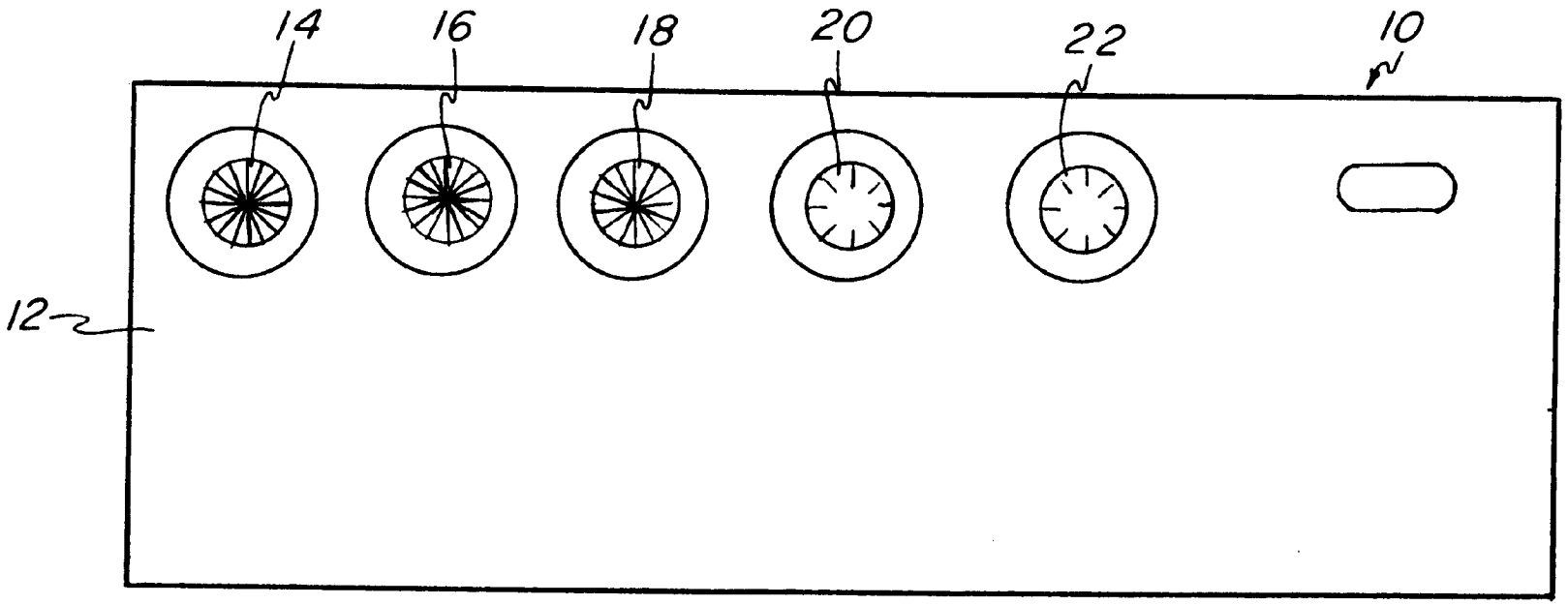
FIG. 1 is a top plan view of a metal fitting cleaner according to the present invention.

Referring to FIG. 1, a preferred embodiment of a metal fitting cleaner 10 according to the invention can be seen. The metal fitting cleaner 10 includes a drive apparatus 12 in combination with a plurality of brushes 14, 16, 18, 20 and 22 of different sizes and configurations. In accordance with an especially preferred embodiment, the first, second and third brushes 14, 16, 18 are outer radial metal brushes having diameters of ½" (13 mm), ¾" (19 mm) and 1" (25 mm), respectively, while the fourth and fifth brushes 20, 22 are inner radial metal brushes having diameters of ½" (13 mm) and ¾" (19 mm), respectively.

Figure 2:
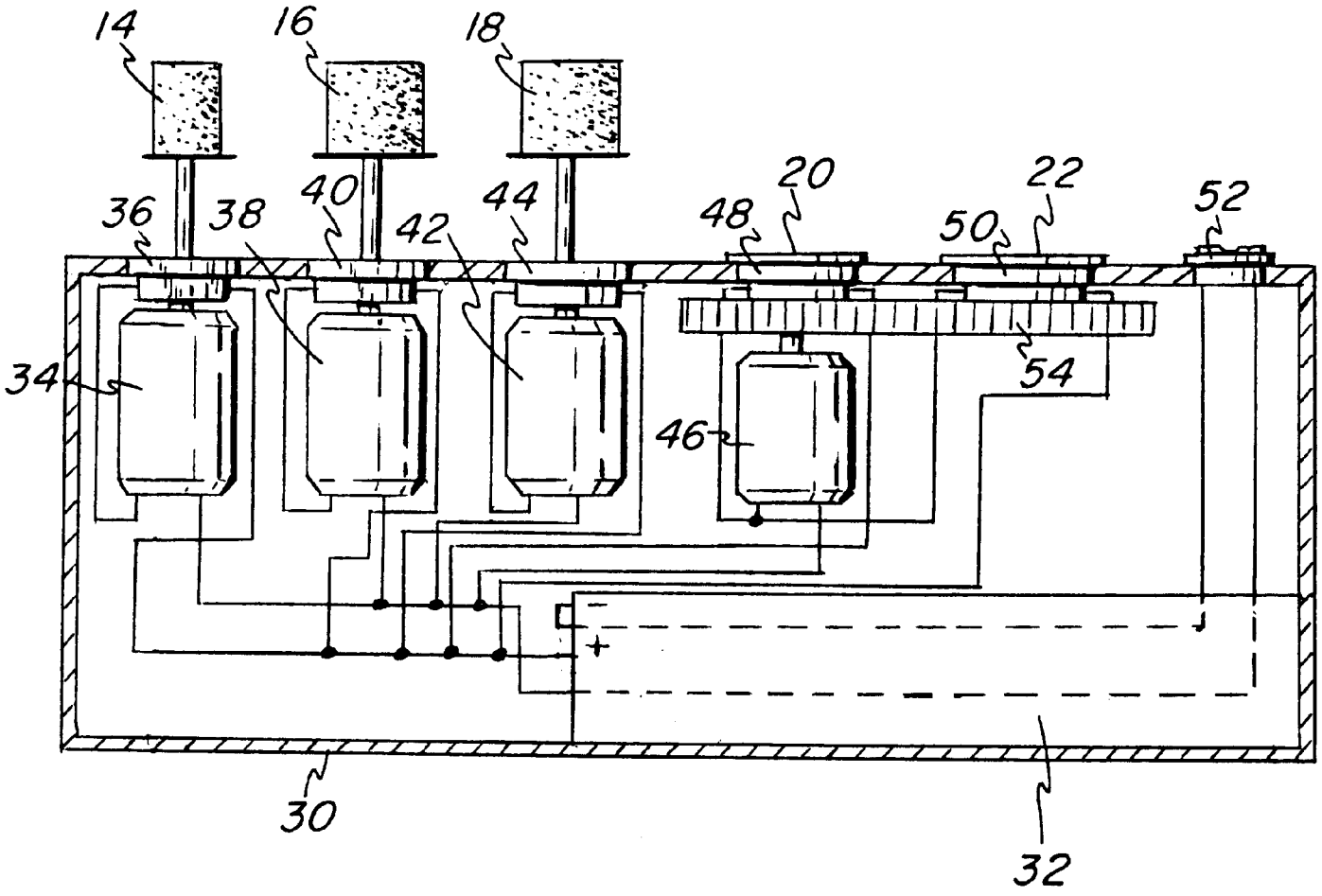
FIG. 2 is a schematic view showing the arrangement parts in the metal fitting cleaner of FIG. 1 and the electrical connections between them.

As best shown in FIG. 2, the drive apparatus 12 includes a box-like support 30 which mounts an electrical power supply 32, a first electric motor 34, a first bearing assembly 36, a second electric motor 38, a second bearing assembly 40, a third electric motor 42, a third bearing assembly 44, a fourth electric motor 46, a fourth bearing assembly 48, a fifth bearing assembly 50 and an on/off switch 52. The fourth and fifth bearing assemblies 48, 50 are connected by a drive belt 54. The support 30 preferably encloses the electrical power supply 32 and the electrical motors 34, 38, 42 and 46 to form a hand-sized grip to enable a user to manually press any one of the brushes 14, 16, 18, 20, 22 against a fitting (not shown) that the user wishes to scour.

Preferably, the electrical power supply 32 includes one or more batteries enclosed in an accessible battery compartment (not shown) in the support 30. Such one or more batteries may be rechargeable. Alternatively, the power supply may include an adaptor and a power cord (not shown) for connection to a standard wall outlet.

The electric motors 34, 38, 42, 46 are preferably conventional low-power electric motors capable of operating at low voltages on the order of 1.5–9 volts. They may be mounted by the support 30 in any conventional manner, as by bolting them to a support panel (not shown) secured, in turn, to an interior surface of the support 30.

Figure 3:
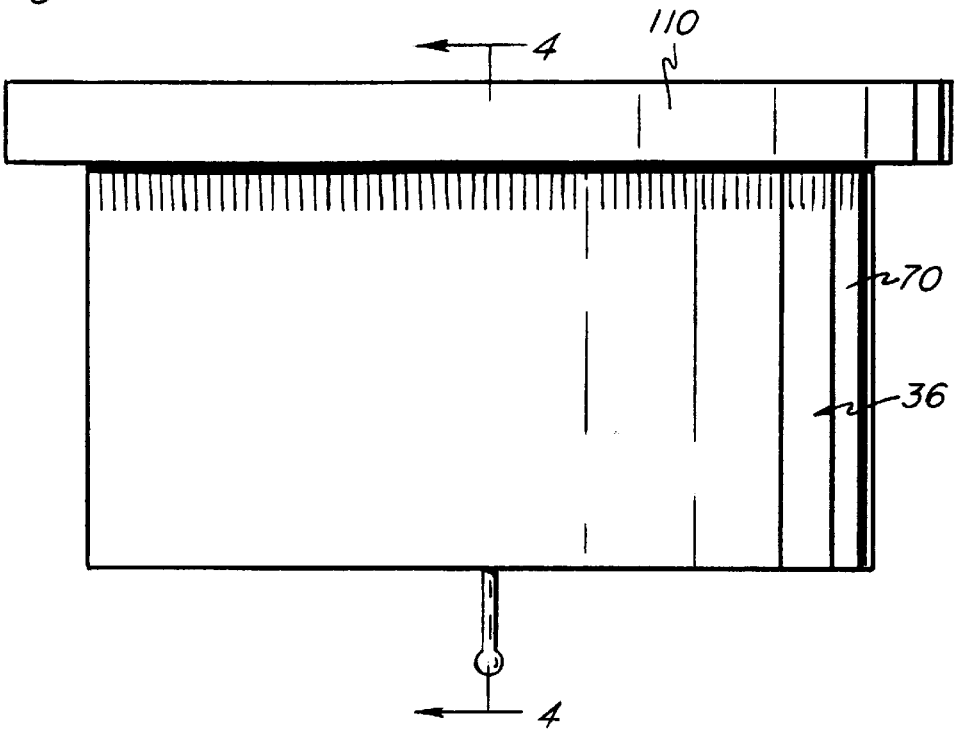
FIG. 3 is a side elevational view of a bearing assembly for the metal fitting cleaner of FIG. 1.
Figure 4:
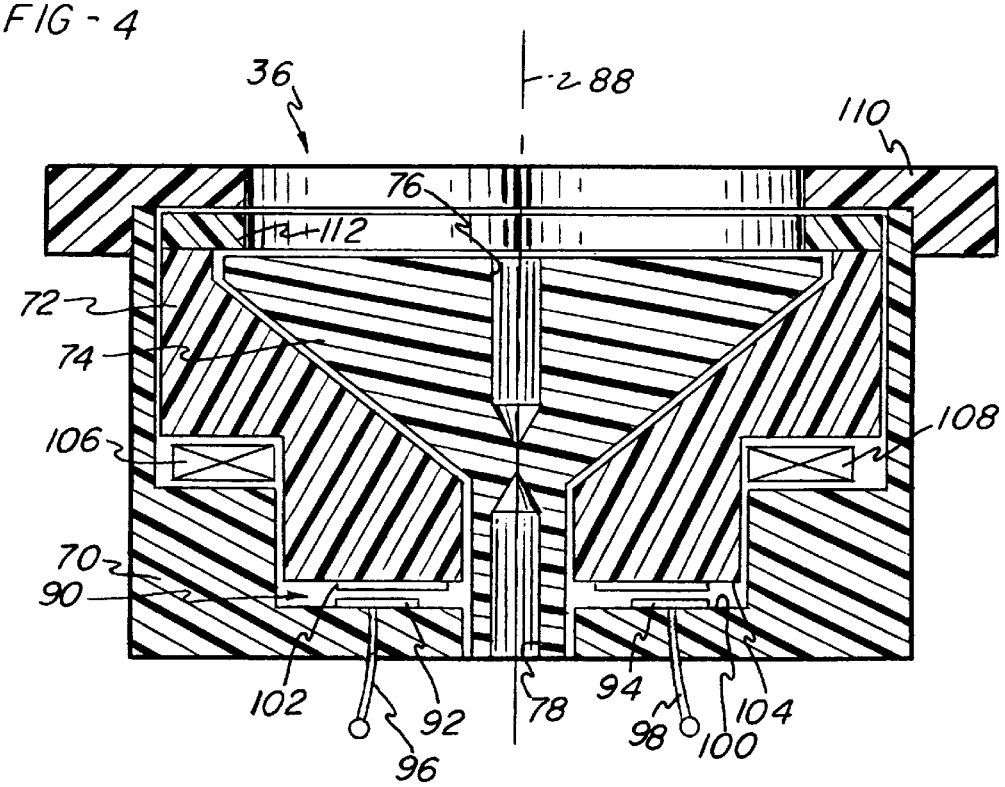
FIG. 4 is a sectional view of the bearing assembly of FIG. 3, taken along the line 4—4 in FIG. 3.

The preferred first, second and third bearing assemblies 36, 40, 44 are identical in construction, as are the preferred fourth and fifth bearing assemblies 48, 50. As best shown in FIGS. 3 and 4, a bearing assembly 36 which may be used in the cleaner 10 (FIGS. 1 and 2) of the present invention includes a bearing housing 70, a bearing seat 72 slidably enclosed in the bearing housing 70 and a frusto-conical bearing pad or coupling member 74 in pivotable engagement with the bearing seat 72. The bearing pad 74 includes an internally splined or knurled bore 76 for detachably mounting the brush 14 (FIG. 2), by means of a friction fit or other conventional means, along an axis 88 through the center of the brush and of the bearing assembly 36. The bearing pad 74 also includes an internally splined bore 78 for mechanically coupling a shaft (not shown) of the first electric motor 34 (FIG. 2) to the first bearing assembly 36 to permit the first electric motor 34 to pivotably drive the first brush 14. Preferably, the internally splined bore 78 provides sufficient clearance to permit the bearing seat 72 to slide over the shaft (not shown) of the first electric motor 34 as it moves relative to the bearing housing 70 when a force is applied along the axis 88.

As best shown in FIG. 4, the bearing housing 70 and the bearing seat 72 cooperate to define a normally-open pressure switch 90 which acts as a pressure-sensitive actuator for the first electric motor 34 (FIG. 2). Spaced switch contacts 92 and 94 in electrical communication with leads 96 and 98, respectively, are provided on an inner surface 100 of the bearing housing 70. A bridging contact 102 is provided on a facing surface 104 of the bearing seat 72 for bridging the switch contacts 92, 94. One or more compression springs 106 and 108 (two shown in FIG. 4) bias the bearing seat 72 with respect to the bearing housing 70 so as to separate the bridging contact 102 from the switch contacts 92, 94. The biasing force provided by the compression springs 106, 108 defines a threshold force characteristic of the pressure switch 90 which must impinge on the switch along the axis 88 before the bridging contact 102 will bridge the switch contacts 92, 94 to close the switch 90. Stop rings 110 and 112 are affixed to the bearing housing 70 and the bearing seat 72, respectively, to maintain the integrity of the first bearing assembly 36.

Returning to FIG. 2, the electrical power supply 32 is connected in parallel with the pressure switches 90 (FIG. 4) in the bearing assemblies 36, 40, 44, 48, 50. The pressure switches 90 (FIG. 4) in the first, second and third bearing assemblies 36, 40, 44, in turn, are connected to leads from the first, second and third electric motors 34, 38, 42, respectively, while the pressure switches (not shown) in the fourth and fifth bearing assemblies 48, 50 are both connected to a lead from the fourth electric motor 46. Opposite leads of the first, second, third and fourth electric motors 34, 38, 42, 46 are all grounded through the on/off switch 52.

When the on/off switch 52 is closed, applying a force on any one of the first, second and third brushes 14, 16, 18, 20, 22 along the axis 88 (FIG. 4) of the corresponding bearing assembly 36, 40, 44 greater than or equal to the threshold force characteristic of the pressure switch 90 (FIG. 4) of the corresponding bearing assembly closes that switch, thereby completing a circuit so as to enable the corresponding electric motor 34, 38, 42 to pivotably drive that brush about the corresponding axis 88 (FIG. 4) independently of the other brushes. Likewise, when the on/off switch 52 is closed, pressing on either the fourth brush 20 or the fifth brush 22 actuates the pressure switch (not shown) in the corresponding bearing assembly 48, 50, thereby enabling the motor 46 to pivotably drive the brushes 20, 22 via the drive belt 54 independently of the first, second and third brushes 14, 16, 18.

It will be understood from the foregoing description that the preferred embodiment of the present invention provides a metal fitting cleaner 10 which is portable and easy-to-use in that it is adapted to be held in the user's hand and actuated by pressure against the pipe or fitting which the user wishes to scour. Since the brushes 14, 16, 18, 20 and 22 are independently driven, power is not wasted driving unused brushes during a scouring operation. The use of separate dedicated electric motors 34, 38, 42 for each brush 14, 16, 18 and the direct mechanical coupling of each motor 34, 38, 42 to its corresponding brush 14, 16, 18 via the bearing assemblies 36, 40, 44 further improves the efficiency of the cleaner 10. This, in turn, reduces the power demanded from the electric motors 34, 38, 42, thereby minimizing the sizes of the electric motors 34, 38, 42 required to drive the brushes 14, 16, 18.

While the forms of apparatus herein described constitute preferred embodiments of this invention, it is to be understood that the invention is not limited to these precise forms of apparatus, and that changes may be made therein without departing from the scope and spirit of the invention which is defined in the appended claims.

What is claimed is:

1. An apparatus for use with a first brush and a second brush for cleaning metal welds and fittings, said apparatus comprising:

a support;

at least one motor mounted by said support;

a first bearing assembly mounted by said support for supporting the first brush for pivotal movement about a first axis, said first bearing assembly including a first pressure-sensitive actuator such that said at least one motor is enabled to pivotably drive the first brush about said first axis independently of the second brush when said first pressure-sensitive actuator detects a first force along said first axis, said first force being no less than a first threshold force; and a second bearing assembly mounted by said support for supporting the second brush for pivotal movement about a second axis, said second bearing assembly including a second pressure-sensitive actuator such that said at least one motor is enabled to pivotably drive the second brush about said second axis independently of the first brush when said second pressure-sensitive actuator detects a second force along said second axis, said second force being no less than a second threshold force.

2. The apparatus as recited in claim 1 wherein said at least one motor includes at least one electric motor; and said first and second pressure-sensitive actuators each include a pressure switch in electrical communication with said at least one electric motor.

3. The apparatus as recited in claim 1 wherein said at least one motor includes a first electric motor mechanically coupled to said first bearing assembly for pivotably driving the first brush about said first axis and a second electric motor mechanically coupled to said second bearing assembly for pivotably driving the second brush about said second axis.

4. The apparatus as recited in claim 3 including an electrical power supply for energizing said first and second electric motors; wherein said first pressure-sensitive actuator includes a first normally-open pressure switch interposed between said electrical power supply and said first electric motor; and said second pressure-sensitive actuator includes a second normally-open pressure switch interposed between said electrical power supply and said second electric motor.

5. The apparatus as recited in claim 4 wherein said electrical power supply is a battery.

6. The apparatus as recited in claim 1 in combination with said first and second brushes, wherein one of said first and second brushes is larger than another of said first and second brushes.

7. The apparatus as recited in claim 1 in combination with said first and second brushes, wherein one of said first and second brushes is an outer radial brush and another of said first and second brushes is an inner radial brush.

8. The apparatus as recited in claim 1 in combination with said first and second brushes, wherein said first brush is detachably mounted on said first bearing assembly and said second brush is detachably mounted on said second bearing assembly.

9. A metal fitting cleaner comprising:

a support;

an electrical power supply;

a first bearing assembly mounted by said support;

a first brush mounted by said first bearing assembly for pivotal movement about a first axis;

a first electric motor mounted by said support, said first electric motor being mechanically coupled to said first bearing assembly for pivotably driving said first brush;

said first bearing assembly including a first normally-open pressure switch in electrical communication with said first electric motor for conducting electrical power from said electrical power supply to said first electric motor when said first normally-open pressure switch detects a first force along said first axis, said first force being no less than a first threshold force;

a second bearing assembly mounted by said support;

a second brush mounted by said second bearing assembly for pivotal movement about a second axis; and a second electric motor mounted by said support, said second electric motor being mechanically coupled to said second bearing assembly for pivotably driving said second brush;

said second bearing assembly including a second normally-open pressure switch in electrical communication with said second electric motor for conducting said electrical power from said electrical power supply to said second electric motor when said second normally-open pressure switch detects a second force along said second axis, said second force being no less than a second threshold force.

10. The metal fitting cleaner as recited in claim 9 wherein said power supply is a battery mounted by said support.

11. The metal fitting cleaner as recited in claim 9 wherein one of said first and second brushes is larger than another of said first and second brushes.

12. The metal fitting cleaner as recited in claim 9 wherein one of said first and second brushes is an outer radial brush and another of said first and second brushes is an inner radial brush.

13. The metal fitting cleaner as recited in claim 9 wherein said first and second brushes are detachably mounted on said first and second bearing assemblies.

* * * * *